United States Patent [19]

Garfinkle

[11] 4,427,052

[45] Jan. 24, 1984

[54] METHOD OF ROTARY REFINING AND CASTING

[76] Inventor: Marvin Garfinkle, 943 E. McPherson St., Philadelphia, Pa. 19150

[21] Appl. No.: 376,038

[22] Filed: May 7, 1982

[51] Int. Cl.[3] ..... B22D 27/02

[52] U.S. Cl. ..... 164/495; 164/497

[58] Field of Search ..... 164/469, 470, 495–497, 164/508, 509, 514, 515; 75/10 C; 373/42–53

[56] References Cited

U.S. PATENT DOCUMENTS 3,152,372 10/1964 Hopkins ..... 164/497

3,597,519 8/1971 Kemeny ..... 164/495 X

*Primary Examiner*—Kuang Y. Lin

[57] ABSTRACT

A method for rotary refining and casting comprising the remelting of an alloy electrode suspended within an essentially cylindrical mold wherein said electrode and said mold are both rotated about their coincident axes of symmetry; heating the tip of said electrode to a sufficiently high temperature to cause melting, with the metal droplets formed at said tip of said electrode descending into said mold under the combined effect of gravitational and centrifugal forces, wherein said droplets form a liquid pool, the free surface of said pool assuming the configuration of a paraboloid of revolution about said axis of rotation, resulting in a shallow pool with high surface area; said pool progressively solidifying into a fine-grain ingot exhibiting high homogeneity and cleanliness; the energy for melting said tip of said electrode and for maintaining said pool molten provided by converting electrical energy to thermal energy at a gap maintained between said electrode and said molten pool.

8 Claims, 6 Drawing Figures

METHOD OF ROTARY REFINING AND CASTING

The development of new alloys to meet the increasingly demanding requirements of critical aerospace components depends in large measure on consumable-electrode remelting to form final ingots essentially free of the internal defects primarily responsible for the premature failure of such components. These defects generally take the form of inclusions or voids, and are slits where internal microcracks can initiate. The susceptibility of a critical component to premature failure under service conditions has been found to be closely related to the size, shape, and number of such defects, and considerable precautions must be taken to minimize their occurrance.

These defects can be classified into two categories. Exogenous defects originate from extraneous material introduced into the molten metal before casting, such as particles detached from the melting crucible or as contaminants on or in the material charged into the crucible. Endogenous defects originate during solidification, particularly when solubility limits are exceeded with decreasing temperature, resulting in the precipitation of gas bubbles and brittle compounds. Because of shrinkage during solidification, direct void formation can also occur. The goal of consumable-electrode remelting is the elimination of such defects as can initiate premature failure.

Generally, alloys for critical components are initially melted from their elemental constituents by the Vacuum-Induction-Melting (VIM) process. The ingredients are melted in a ceramic crucible by electric induction heating within a vacuum chamber. The chamber is large enough to also hold the molds into which the melt will be poured so that the entire melting and casting procedure can be completed out of contact with the atmosphere so as to eliminate this source of contamination.

While the physical properties of alloys produced by the VIM process are considerably better than comparable alloys melted and cast in air in terms of tensile ductility, impact strength, and fatigue resistance, these properties can still be substantially improved by consumable-electrode remelting. Accordingly, the alloys produced by the VIM process for critical components are cast into cylindrical electrodes that serve as the source of metal and as an electrical conductor in the remelting procedure.

Remelting takes place within an externally water-cooled open-ended copper mold substantially cylindrical in cross-section with a diameter larger than the electrode, and the electrode is suspended within the mold. The electrode and the mold are connected to a suitable source of electric power. Electrical energy is converted to sufficient thermal energy at a gap maintained between the electrode-tip and the mold-bottom that the tip melts, resulting in the formation of molten droplets that fall to the mold bottom. Consequently, an ingot is gradually built up within the mold at the rate at which metal is transferred from the electrode, and the process is complete when the electrode is substantially consumed.

The upper end of the growing ingot is occupied by a molten pool of metal that is deepest at its center and whose shallow periphery, being in contact with the cold wall of the mold, freezes before any fusion with the wall can occur. Essentially, the molten metal is constrained within a container of its own composition, with the mold serving primarily as an electrical and thermal conductor.

Because the thermal energy created at the gap heats both the electrode tip and the pool, the rate of metal transfer and the pool depth are closely interrelated, so that a high melt-off rate results in a deep pool. However, a shallow pool is desired for ingot homogeneity and fine grain size, while a high melt-off rate is desired for economic operation. In actual practice, these conflicting requirements compromise both productivity and quality.

Two commercial processes are generally utilized for the refining of alloys by consumable-electrode remelting. These are the Electro-Slag Remelting (ESR) process and the Vacuum-Arc Remelting (VAR) process, and they differ primarily in the manner in which the electrical energy is converted to thermal energy at the electrode-ingot gap; and the environment within which this conversion occurs. Disadvantages associated with these remelting processes are discussed, as is the manner by which they are ameliorated by the rotary refining and casting method.

BACKGROUND OF THE INVENTION

Figure 1A:
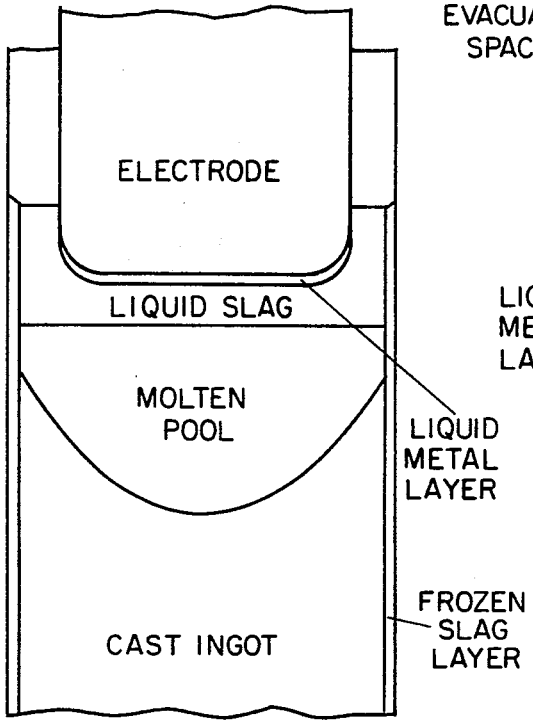
FIG. 1A illustrates a schematic representation of the ESR process.

During the ESR process, a molten layer of slag is maintained above the molten metal pool. The electrode tip dips into the slag layer as shown in FIG. 1A, and electrical energy is converted into thermal energy by direct resistance heating of the slag. The slag composition is usually based on calcium fluoride, and it is capable of readily fluxing and removing oxide and sulphide inclusions. A coating of slag freezes on to the mold wall as shown so that the ingot does not directly contact the mold surface.

During remelting, globules of liquid metal drip off of the tip of the electrode and inclusions that are soluble in or react with the slag are removed as the drops descend to the molten pool below. The pool bottom assumes roughly the configuration of a paraboloid of revolution about the axis of symmetry of the mold, and during normal operation of the maximum pool depth is approximately one-half the diameter of the ingot.

While most of the thermal energy generated at the gap is carried into the ingot to maintain the molten pool, a substantial portion of the energy generated is carried directly to the mold wall through the slag, and is therefore a total loss. Consequently, the power efficiency of the ESR process is quite poor compared with the VAR process.

Figure 1B:
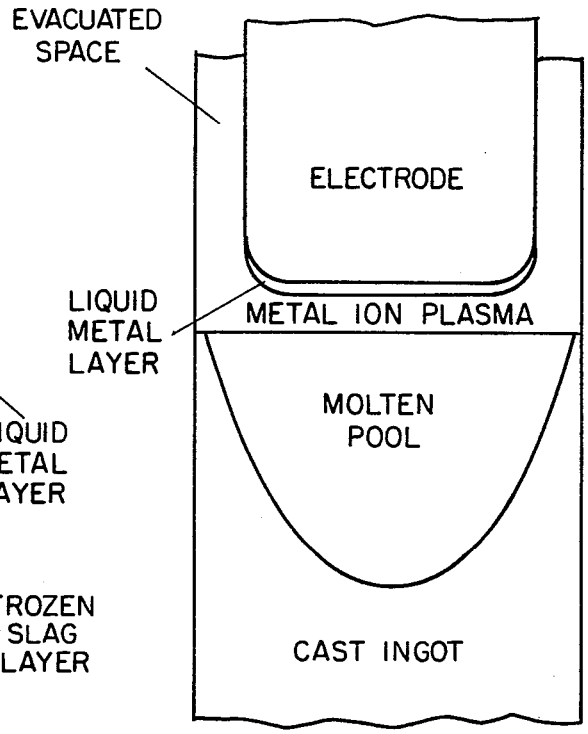
FIG. 1B illustrates a schematic representation of the VAR process.

During the VAR process, the mold is evacuated, so that remelting occurs within a hermetically-sealed chamber. The chamber is maintained at a sufficiently low pressure by vacuum pumps that the mean-free-path of the residual gases in the chamber is greater than the gap width between the electrode tip and the molten pool. Under these conditions, an arc struck between the electrode and the ingot is maintained by a metal ion plasma as shown in FIG. 1B. Electrical energy is converted into thermal energy within the arc.

The vacuum arc conversion of electrical energy into thermal energy is normally a relatively stable process, but when it involves liquid metal transfer through the plasma, as in the VAR process, it can become quite erratic. During remelting, the bottom surface of the electrode is relatively flat and covered with liquid metal. Actual metal transfer occurs by a protuberance forming on the liquid surface, which then elongates until it reaches the metal pool, momentarily short-circuiting the arc. The magnetic field associated with the current flow through the protuberance tends to pinch it off, and the arc reignites. Arcing is not uniform however, and is instead concentrated at various points on the tip surface. As these tend to superheat localized areas of the surface, the temperature of the electrode tip is not uniform.

Under the combined influence of the intense arc and the low pressure, volatile inclusions and dissolved gases are removed as the protuberances elongate to the molten pool below. Insoluable inclusions tend to float on the surface of the molten pool. The pool bottom assumes roughly the configuration of a paraboloid of revolution about the axis of symmetry of the mold, and during normal operation the maximum pool depth is approximately two-thirds the diameter of the ingot.

The ESR process and the VAR process produce ingots of the highest commercial cleanliness, but ironically this very cleanliness introduces a serious problem. The lack of sites for grain nucleation and the deep metal pool associated with these processes both promote the formation of large columnal grains in the cast ingot. Consequently, because grain-boundary area is relatively small, the contaminants that are present tend to concentrate in these areas, which can adversely affect subsequent working of the ingots. Moreover, microsegregation of alloy constituents is promoted by these conditions.

Even more detrimental to ingot homogeneity is macrosegregation, which is promoted by pool agitation. Because magnetohydrodynamic stirring of a conducting fluid in a magnetic field increases with pool depth, the deep pool present during remelting promotes macrosegregation of alloy constituents.

OBJECTIVE OF THE INVENTION

The rotary refining and casting method as designed to alleviate these described disadvantages associated with the ESR process and the VAR process. This purpose is achieved by introducing another control variable into the remelting process that permits the melt-off rate and the pool depth to be adjusted essentially independently of one another over a wide range of operating requirements.

Essentially, the power consumed during remelting is a product of the current density, the potential gradient, and the gap volume within which the electrical energy is converted into thermal energy. The melt-off rate depends primarily on total power consumption while the pool depth depends on the rate of heat flow per unit area into the surface of the pool and the rate of heat loss per unit area through the solidification front. The heat flow into the pool is related to the current density while the heat loss is related to the cooling capacity of the heat-dissipation system.

Because the geometry of the pool surface is fixed, the current density cannot be adjusted independently of the potential gradient, and hence in practice the current density varies essentially with power consumption. Consequently, high melt-off rates result in deep pools during remelting.

Consider however if the geometry of the pool could be adjusted so as to increase both its free surface and its solidification surface areas. The result would be that heat flow into the pool would decrease because the current density would decrease, and heat loss from the pool would increase because of the greater heat-dissipation area available. Consequently, without decreasing the power consumption and thus the melt-off rate, a shallower pool would result. This objective can be achieved if the surface of the molten pool, instead of being configured as a flat disc, could assume a shape with a greater surface area.

When a cylindrical shell partially filled with a fluid is rotated about its vertical axis of symmetry, the free surface of the fluid assumes the shape of a paraboloid of revolution about the axis of rotation. The height h that the fluid surface assumes above the base of the paraboloid at a radial distance r from the axis of rotation is related to the angular velocity $\Omega$ by the equation $$h=(\Omega^2/2g)r^2$$

where g is the normal acceleration of gravity.

As the free surface deviates from that of a flat disc, its surface area must increase with increasing angular velocity. This increase in surface area with rotation, if it were the surface area of the molten pool during remelting, would result in a proportional decrease in current density without a corresponding decrease in power expended. Hence, the ratio of the current density at the parabolic surface to that at the disc surface is inversely proportional to the ratio of the area of the parabolic surface to that of the disc surface $S_p/S_d$. This ratio is related to the angular velocity by the equation $$S_p/S_d=1.33(\Omega^2/2g)r_o+1$$

where $r_o$ is the maximum radius of the molten pool.

Figure 2A:
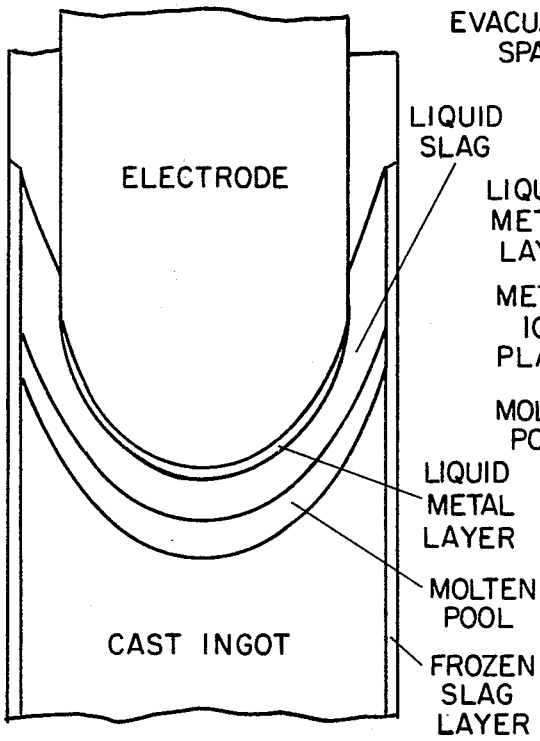
FIG. 2A illustrates a schematic representation of the rotary refining and casting method employing electric-resistance remelting.
Figure 2B:
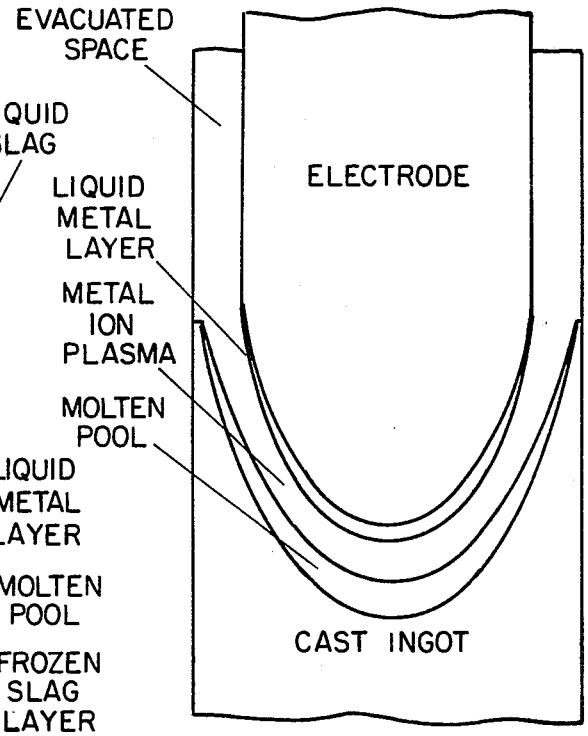
FIG. 2B illustrates a schematic representation of the rotary refining and casting method employing electric-arc remelting.

The consequence of rotating the molten pool on its free surface configuration is schematically represented in FIG. 2A and FIG. 2B for electric-resistance remelting and for electric-arc remelting by the rotary refining and casting method, respectively. Assuming other parameters constant, the energy absorbed per unit surface area with rotation is substantially less than that absorbed per unit of flat disc area. That is, current density is decreased without reducing the total power consumed, so that a shallow pool results without diminishing the melt-off rate. Consequently, both ingot homogeneity and microstructure are improved without sacrificing productivity.

Moreover, pool rotation has a direct effect on heat dissipation. Because "the free surface of the pool is not perpendicular to the mold wall when the pool is subject to rotation, the included angle between the pool surface and the mold wall is less than ninety degrees, and consequently". the heat-flow path from the pool surface to the wall is considerably shorter, significantly increasing the rate of heat loss from the pool. Hence, a higher power expenditure and corresponding melt-off rate is possible without enlarging the thermal capacity of the cooling system.

During electric-resistance remelting by the rotary refining and casting method, heat is lost from the slag through both the molten pool and directly to the mold wall as illustrated in FIG. 2A, the latter loss being a total waste. However, the ratio of the slag-pool interfacial area to the slag-mold interfacial area is substantially larger with rotation than without, so that the proportion of energy lost from the slag to the wall and pool shifts significantly towards the pool with rotation. This shift indicates that a substantial improvement in energy efficiency in electric-resistance remelting can also be realized by pool rotation.

Independent of pool rotation, the electrode tip will roughly conform to the surface configuration of the molten pool. That is, where the electrode surface is in closest approach to the pool surface, melt-off is fastest because local current flow is greatest. Hence, essentially a uniform gap width is maintained, independent of pool surface configuration. However, with pool rotation, the lower surface of the electrode is no longer flat, so that molten metal on the electrode surface will tend to flow to the lowest point on that surface, and there stream off to the pool below. Such streaming will now only defeat the refining process but would short-circuit the current as well.

However, by imparting rotary motion to the electrode about an axis coincident to the axis of rotation of the pool, the molten metal leaves the electrode surface at an angle essentially normal to that surface, depending on the angular velocity of the electrode. The angle $\theta$ that the metal leaves the surface, relative to the axis of rotation, is proportional to the radial distance r.

$$\theta = \tan^{-1}[(\Omega^2/2g)2r]$$

The direction of electrode rotation relative to pool rotation has a direct effect on the refining process. Because a stable slag layer without agitation is desirable in electric-resistance remelting by the rotary refining and casting method so as not to disturb the molten pool, electrode rotation in the same direction and essentially at the same speed as pool rotation is required. Because the free surface configuration of a fluid under rotation is independent of fluid density, the free surface of the slag assumes the same shape as the free surface of the pool when pool, slag, and electrode rotate essentially as a unit.

During the ESR process, drops leave the molten layer on the bottom of the electrode when their weight is great enough to overcome surface tension. However, the drops are buoyed up by the slag, and consequently they can grow to a size greater than optimum for slag refining. However, under the combined gravitational and centrifugal forces present with electrode rotation as provided by the rotary refining and casting method, fine droplets are torn from the molten layer on the electrode surface. Because of their high surface-area to volume ratio, fine droplets are far more amenable to refining than are the more massive drops. Moreover, the droplets move apart while descending under centrifugal loading, which reduces interdroplet interference to refining.

A distinct advantage is present if the direction of electrode rotation is counter to the direction of pool rotation during electric-arc remelting by the rotary refining and casting method. Droplets on contact with the pool tend to shear because of the abrupt change in angular velocity. This tends to smear the droplets over the surface of the pool, greatly reducing the adverse effect of segregation in the electrode on ingot homogeneity.

During the VAR process, molten metal leaves the electrode as protuberances that elongate, and upon which reaching the pool surface momentarily short-circuit the current flow. However, under the combined gravitational and centrifugal forces present with electrode rotation as provided by the rotary refining and casting method, fine droplets are torn from the molten layer on the electrode surface. Because protuberances are virtually eliminated by electrode rotation, electric-arc remelting by the rotary refining and casting method results in a drizzle of molten droplets through a relatively stable plasma.

Hence, in comparison to conventional consumable-electrode remelting processes, electrode rotation results in improved refining while mold rotation results in improved microstructure. Taken together, the resulting rotary refining and casting method provides unique advantages, including higher energy efficiency, finer grain size, improved homogeneity, better productivity, and greater cleanliness.

SUMMARY OF THE INVENTION

According to the invention an apparatus is provided for refining and casting alloy ingots which comprises a water-cooled cylindrical mold provided with a water-cooled mold-bottom situated upon a rotatably-supported base-plate, with means provided to rotate said base-plate about the vertical axis of symmetry of said mold. Suspended within said mold is an electrode with a nominal composition corresponding to that of said ingot being cast within said mold, said electrode provided with means of rotation about an axis coincidental to that of said mold. Said electrode being suitably spaced from said mold so as to provide a gap between the tip of said electrode and said ingot being cast. By suitable connection with a source of electric power, a potential difference is maintained between said electrode tip and said ingot, with the electrical energy converted to thermal energy within said gap sufficient to melt said electrode tip and maintain a molten pool upon said ingot, with the free surface of said pool assuming the configuration of a paraboloid of revolution about the axis of rotation. In one embodiment of the invention a molten slag occupies said gap, and electrical energy is converted to thermal energy by direct resistance heating of said slag. In another embodiment of the invention said gap is evacuated, and electrical energy is converted to thermal energy by a metal-ion plasma arc.

PREFERRED EMBODIMENTS OF THE INVENTION

Figure 3A:
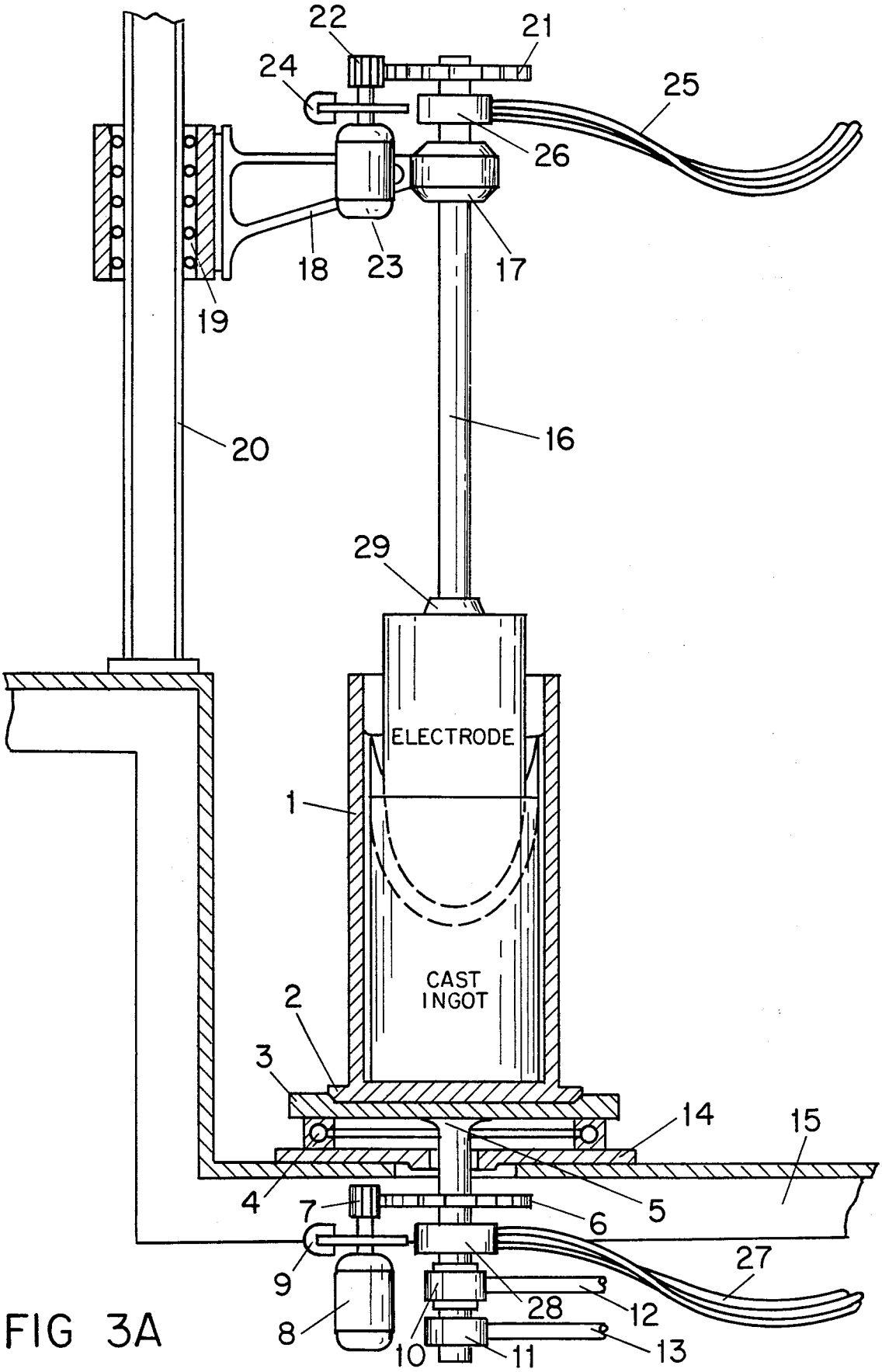
FIG. 3A illustrates a rotary refining and casting apparatus employing electric-resistance remelting.

FIG. 3A illustrates a cutaway view of the invention. The cylindrical mold 1 is secured to the mold bottom 2 and both are fluid cooled by internal passageways in the conventional manner. The mold bottom 2 is secured to the base-plate 3 that is supported by bearing 4. In this manner the mold 1 can be rotated about its vertical axis of symmetry. A shaft member 5 is secured to the base-plate 3 at its center of rotation, and means to rotate shaft 5 is provided by gear 6 secured to the shaft and which meshes with gear 7, which is secured to the shaft of electric motor 8. Motor speed is controlled by suitable circuitry which can provide dynamic braking upon completion of the remelting process. Friction braking is provided by mechanical brake 9.

Cooling fluid is provided through conventional rotary seals 10 and 11 from pipes 12 and 13, and thence through shaft 5 to base plate 3, from whence it is distributed to mold 1 and mold bottom 2. The aforementioned gearing, motor, and fluid seals are isolated from the remelting process by shielding plate 14 secured to support structure 15.

The electrode suspension shaft 16 is rotatably supported by bearing 17 which is secured to support arm 18. Arm 18 is slidably supported by bearing 19 on column 20. The support arm 18 is electrically insulated from the base-plate 3.

The means to rotate shaft 16 is provided by gear 21 secured to the shaft and which meshes with gear 22, which is secured to the shaft of electric motor 23. Motor speed is controlled by suitable circuitry which can provide dynamic braking upon completion of the remelting process. Friction braking is provided by mechanical brake 24.

Electrical connections are made from power cable 25 through slip ring 26 on shaft 16, from where electric power is carried to the consumable electrode through clamp 29; and from power cable 27 through slip ring 28 on shaft 5, from where electric power is carried to mold 1 through base-plate 3. The embodiment of the rotary refining and casting method as illustrated is suitable for electric-resistance remelting. For electric-arc remelting, shielding from the atmosphere must be provided.

Figure 3B:
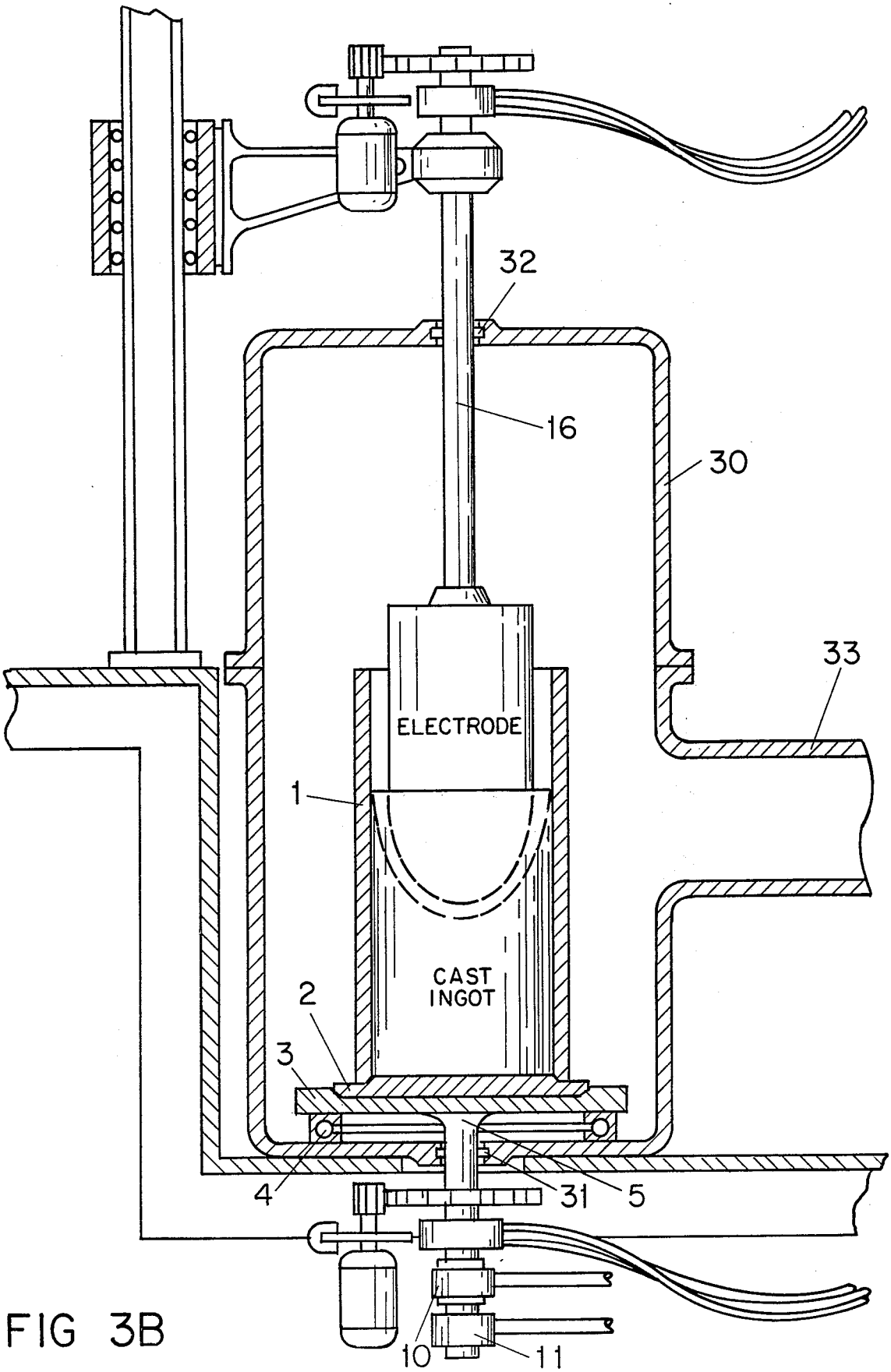
FIG. 3B illustrates a rotary refining and casting apparatus employing electric-arc remelting.

FIG. 3B illustrates a cutaway view of the invention. The hermetically-sealed chamber 30 encloses the mold 1, mold bottom 2, base-plate 3, and bearing 4. Shaft 5 and shaft 16 pass through rotary vacuum seals 31 and 32, respectively. The chamber 30 is connected to a vacuum-pumping system by vacuum line 33. Because the rotary water seals 10 and 11 are outside the vacuum chamber, they can be of conventional construction.

While there have been described what are at present considered to be the preferred embodiments of this rotary refining and casting method, it will be obvious to those skilled in the art that various changes and modifications may be made therein without departing from the invention, and it is aimed therefore, in the appended claims to cover all such changes and modifications as fall within the true spirit and scope of the invention.

What is claimed is:

1. A method of alloy refining and casting wherein an electrode of the nominal composition of the ingot to be cast is vertically and rotatably suspended over a fluid-cooled mold within which said ingot is cast, said mold rotatably supported so that the axis of rotation of said mold and said electrode are coincidental;

heating the top of said ingot to above its melting point so as to form a molten pool whose free surface assumes the configuration of a paraboloid of revolution about said axis of rotation under the combined effect of gravitational and centrifugal forces;

and heating the tip of said electrode to above its melting point so as to form droplets that diverge from the surface of said electrode under the combined effect of gravitational and centrifugal forces, with said tip of said electrode assuming essentially the same configuration as said free surface of said molten pool.

2. The method of alloy refining and casting according to claim 1 wherein said tip of said electrode is so spaced from said top of said ingot as to maintain a gap between them, said tip of said electrode melted and said pool maintained molten by the passage of an electric current across said gap, and with the conversion of electrical energy to thermal energy by direct resistance heating of a molten slag maintained within said gap.

3. The method of alloy refining and casting according to claim 1 wherein said tip of said electrode is so spaced from said top of said ingot as to maintain a gap between them, said tip of said electrode melted and said pool maintained molten by the passage of an electric current across said gap, with said gap maintained evacuated, and with the conversion of electrical energy to thermal energy by a metal-ion plasma arc maintained within said gap.

4. The method of alloy refining and casting according to claim 1 wherein a fine-grain ingot is cast by maintaining a shallow metal pool and thereby inhibiting dendritic growth, said shallow pool established by depressing the center of said free surface of said molten pool under the combined effect of gravitational and centrifugal forces.

5. The method of alloy refining and casting according to claim 1 wherein a homogeneous ingot is cast by maintaining a shallow metal pool and thereby inhibiting agitation, said shallow pool established by depressing the center of said free surface of said molten pool under the combined effect of gravitational and centrifugal forces.

6. The method of alloy refining and casting according to claim 1 wherein ingot cleanliness is improved by the transfer of fine metal droplets across said gap under the combined effect of gravitational and centrifugal forces.

7. The method of alloy refining and casting according to claim 2 wherein energy efficiency is improved by increasing the slag surface area exposed to said free surface of said molten metal pool in relation to said slag surface area directly exposed to the fluid-cooled wall of said mold under the combined effect of gravitational and centrifugal forces.

8. The method of alloy refining and casting according to claim 3 wherein energy efficiency is improved by increasing said free surface area of said molten metal pool exposed to said arc in relation to the area of the fluid-cooled wall of said mold directly exposed to said arc under the combined effect of gravitational and centrifugal forces.

* * * * *